US006520791B2

(12) United States Patent
Burger

(10) Patent No.: US 6,520,791 B2
(45) Date of Patent: Feb. 18, 2003

(54) ELECTRICAL CONNECTOR JACKSCREW SYSTEM

(75) Inventor: Edward W. Burger, Fernandina Beach, FL (US)

(73) Assignee: Tyco Electronics Logistics AG, Steinach (CH)

( * ) Notice: Subject to any disclaimer, the term of this patent is extended or adjusted under 35 U.S.C. 154(b) by 0 days.

(21) Appl. No.: 09/950,075

(22) Filed: Sep. 12, 2001

(65) Prior Publication Data

US 2002/0173195 A1 Nov. 21, 2002

Related U.S. Application Data

(60) Provisional application No. 60/292,259, filed on May 21, 2001.

(51) Int. Cl.[7] ..... H01R 13/627
(52) U.S. Cl. ..... 439/362
(58) Field of Search ..... 439/362, 378, 439/359

(56) References Cited

U.S. PATENT DOCUMENTS 4,865,560 A 9/1989 Thomas
4,929,184 A * 5/1990 Emadi et al. ..... 439/681
5,391,091 A 2/1995 Nations
5,628,653 A 5/1997 Haas et al.
5,766,035 A 6/1998 Alibert
6,056,581 A 5/2000 Rothenberger

* cited by examiner

*Primary Examiner*—Gary Paumen
*Assistant Examiner*—Ann McCamey

(57) ABSTRACT

A jackscrew system preventing undesired problems during mating and de-mating of miniature electrical connectors. The jackscrew includes a thrust shoulder that separates the jackscrew threads from the remainder of the shaft. A "C-shaped" retaining ring is closed onto a diameter of the jackscrew shaft adjacent shoulder and the head of the jackscrew. A counter-bore is provided in the plug connector body into which the crimp ring enters when under the load of de-mating the connector from the receptacle. The counter-bore acts to restrict the crimp ring from opening under mating and de-mate forces when the thrust shoulder applies such forces against the crimp ring land thereby against the plug body, and thus assures retention of the crimp ring under mating and de-mating operating conditions.

25 Claims, 2 Drawing Sheets

ELECTRICAL CONNECTOR JACKSCREW SYSTEM

CLAIM FOR BENEFIT OF EARLIER FILING DATE

This application claims the benefit of U.S. Provisional Application No. 60/292,259, filed May 21, 2001, this application having the same tile and inventor as said provisional application.

BACKGROUND OF THE INVENTION

The background of the invention will be discussed in two parts.

1. Field of the Invention

This invention relates to mating and de-mating of electrical connector sub-assemblies having multiple electrical connections that employ a jackscrew to bring the sub-assemblies together in mutual alignment, and more particularly to a two-part jackscrew system for preventing undesired mating and de-mating problems during mating and de-mating of miniature electrical sub-assemblies. Employed is a captive retainer, or thrust ring crimped around the jackscrew shaft that acts to restrict the thrust ring from opening under mounting and de-mounting load forces.

2. Description of the Related Art

Electrical connector assemblies in which multiple electrical connections are to mate simultaneously commonly consist of two sub-assembly connectors, one generally having an array of male contacts, and another having a corresponding, or complimentary, array of matching receptive female contacts. A pair of jackscrew couplings is commonly used for aligning and capturing the sub-assemblies to effect proper alignment and reliable electrical contact between the two sub-assemblies.

Although there have been improvements in related art jackscrew systems, most typically include E-rings for capturing the screw. However, E-rings are prone to dislodge under thrust or screw rotation conditions during mating and de-mating of the assemblies, such dislodgment of the E-ring often accompanied by displacement, or fall-out, of the screw thereby creating serious problems. For instance, E-ring dislodgment often causes electrical shorts in surrounding electrical circuits. Further, the E-ring is substantially larger than the jackscrew shaft in order to provide three-point leveraged locking force with the shaft. During mating and de-mating procedures the E-ring must rotate freely with the shaft and if either ear of the E-ring should encounter an obstacle during such rotation the E-ring, will unlock from the shaft and fall off, thus freeing the jackscrew from the connector body.

This has been a problem, especially with miniature connectors, as it is difficult for the E-ring to rotate with the shaft without hitting some part of the plug and thus being forced off the shaft. To enlarge the connector bodies to accept the E-ring would be contra-productive for miniaturization of the connectors. A known apparatus for mating an electrical plug and receptacle having a jackscrew E-ring in accordance with the prior art is disclosed in U.S. Pat. No. 4,865,560 issued to Thomas on Sep. 12, 1989, which patent is incorporated by reference herein.

Other jackscrews and jackscrew couplings, exemplary of the related art for mating and de-mating electrical assemblies having multiple electrical connectors, are shown and described variously in U.S. Pat. No. 5,391,091 issued to Nations on Feb. 21, 1995, U.S. Pat. No. 5,628,653 issued to Haas et al. on May 13, 1997, U.S. Pat. No. 5,766,035 issued to Alibert on Jun. 16, 1998, and U.S. Pat. No. 6,056,581 issued to Rothenberger on May 2, 2000.

However, in light of prior art problems, what is needed is improved jackscrew means for mounting and de-mounting electrical sub-assemblies that provides mechanical and electrical reliability, uses a minimum number of parts, is inexpensive to produce, and can be quickly assembled and replaced with assured quality and reliability. It is thus an object of the present invention to provide an improved two-part jackscrew system that instead of an E-ring, employs.a captive retainer, or thrust ring, crimped around the jackscrew shaft that acts to restrict the thrust ring from opening under mounting and de-mounting load forces. The present invention has particular application to miniature electrical assemblies having multiple electrical connectors.

SUMMARY OF THE INVENTION

The present invention is directed toward providing an improved jackscrew system preventing undesired problems encountered in mating and de-mating of electrical sub-assemblies having multiple electrical connectors, and especially of miniature electrical sub-assemblies.

This improvement is accomplished by providing a two-part jackscrew system that captivates the screw during mating and de-mating of the electrical connectors thus preventing problems arising from dislodgment of the screw. The system utilizes a thrust shoulder addition to the jackscrew that separates the jackscrew threads from a non-threaded portion of the screw shaft, and a retaining or crimp, ring. The retaining ring is generally C-shaped in the form of an annular ring, or washer, with an annular portion removed. The ring is crimped, or closed, about the non-threaded portion of the jackscrew shaft and positioned substantially against the thrust shoulder. The ring is fabricated of spring material and has a thickness approximately one-third of the inner diameter of the ring. The ring edges are substantially free of burrs and have corner radii of about 0.001 inches.

A counter-bore is provided in the connector, or plug, body that accepts the jackscrew. The crimp ring enters the counter-bore when under the load of de-mating this connector, or plug, body from the mated, or receptacle, connector body. The counter-bore acts to restrict the crimp ring from opening under de-mate forces when the thrust shoulder applies such forces against the crimp ring and thereby against the plug body, and thus assures retention of the crimp ring under operating conditions.

Thus, in operation as described, for each of the jackscrews the interrelated action of the jackscrew, jackscrew shoulder, retaining ring, and the body surface of the counter-bored recess collectively serve to capture the jackscrew to prevent the usual de-mounting problems associated with mating and de-mating electrical sub-assemblies.

The plug body counter-bore further serves to provide an axial tolerance to assure sufficient jackscrew thread engagement with the receptacle body. Additionally, the crimp ring, when crimped around the jackscrew shaft, creates thrust interaction with the screw shoulder to allow for self-centering of the screw when engaged with the receiving threads of the receptacle body.

DETAILED DESCRIPTION OF THE INVENTION

Figure 1:
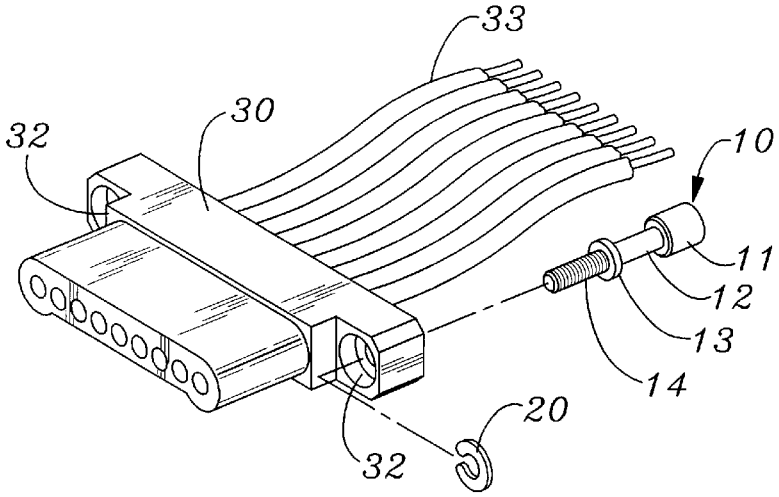
FIG. 1 is a perspective view of the jackscrew system of the invention showing the connector housing and an exploded view of the jackscrew and retainer ring.

The invention relates to a jackscrew system for mating and de-mating miniature electrical sub-assemblies having multiple electrical connectors, and more particularly, to a jackscrew system preventing undesired mounting and de-mounting problems during connection and disconnection of the sub-assemblies. Although in mating and de-mating of miniature electrical sub-assemblies two jackscrew systems are normally used, for simplicity only one will be described. Referring now to the drawings wherein the same reference numerals designate the same elements in the various views, the details of the invention will be described.

As shown in FIG. 1, the jackscrew system of the invention is comprised of two parts, the jackscrew generally designated 10, and the retaining, or crimp, ring 20. Jackscrew 10 includes jackscrew head 11 with a shaft extending longitudinally therefrom, the shaft having a non-threaded portion 12 immediately following head 11 terminated by a shoulder 13 extending axially from portion 12, and then following the shoulder 13 a threaded portion 14 that completes the shaft.

The non-threaded portion 12 may include a shear-groove, such as groove 41, directly following, or beneath, the head 11. This shear-groove acts to cause head 11 to shear off from the shaft when excess torque is applied to head 11. The exposed shaft may then be easily accessed, removed and replaced. Otherwise, shearing may occur at the minor thread diameter within the receiving threaded area resulting in inability to remove the captured broken off threaded portion.

As further shown, sub-assembly connector 30 has connected thereto multiple electrical leads 33 and apertures 31 (see FIG. 3) for receiving the jackscrew system in accordance with the invention. Apertures 31 have counter-bored recesses 32 for receiving retaining ring 20 as will hereinafter be further described.

Retaining, or crimp, ring 20, shown apart from connector body 30, is generally C-shaped in the form of an annular ring, or washer, with an annular portion removed. Although the portion removed is not of a dimension to allow for normal fitting of the ring over the non-threaded portion 12 of jackscrew 10, the flexibility of the material of the ring 20 permits it to be crimped, or snapped, in the usual manner onto non-threaded portion 12. The removed portion is such that upon being crimped onto non-threaded portion 12 substantially against the thrust shoulder 13, the open ends, or tangs, may abut each other but not overlap.

Typically for miniature connectors in accordance with the invention, the ring 20 is made of stainless spring steel material with a pre-crimp outside diameter of approximately 0.070 inches and an inside diameter of approximately 0.037 inches. In order to withstand the stress to be experienced during mating and de-mating of the connectors, the thickness of the ring 20 is approximately one third ($1/3^{rd}$) of the inside diameter. However, this thickness can vary depending on the other dimensions and/or composition of the selected ring material. To prevent scouring and material break-off, it is important that "burrs" or other irregularities on the outside diameter surfaces of the ring 20 are minimized. It is further desirable that the corners of these surfaces are rounded to radii of about 0.001 inches.

Figure 2A:
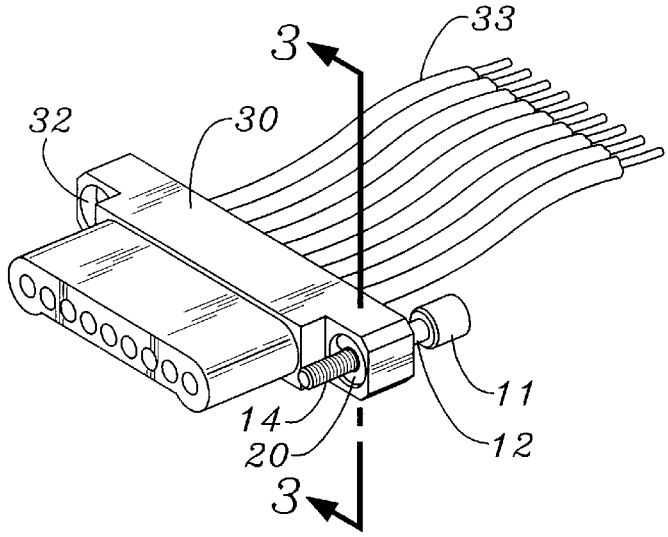
FIG. 2A is a perspective view of the jackscrew system as shown in FIG. 1 connected to the connector housing.
Figure 2B:
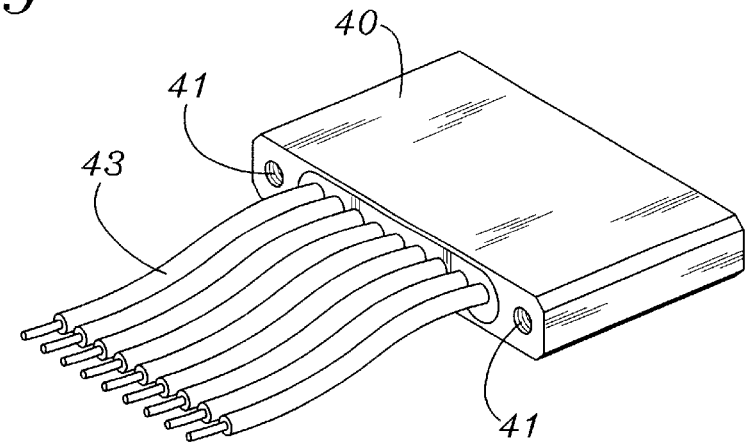
FIG. 2B shows in perspective view a second connector housing to be mated to the connector housing of FIG. 1.

Referring to FIG. 2A, there is shown jackscrew 10 positioned in sub-assembly connector body 30 in accordance with the invention. Jackscrew 10 is inserted through aperture 31 of connector body 30 with crimp ring 20 crimped, or snapped, loosely onto non-threaded portion 12 behind shoulder 13. FIG. 2B shows sub-assembly connector body 40 to be mated to connector body 30. As shown, body 40 has electrical leads 43 corresponding as required to leads 33, and threaded apertures 41 for receiving threaded portion 14 of jackscrew 10.

Figure 3:
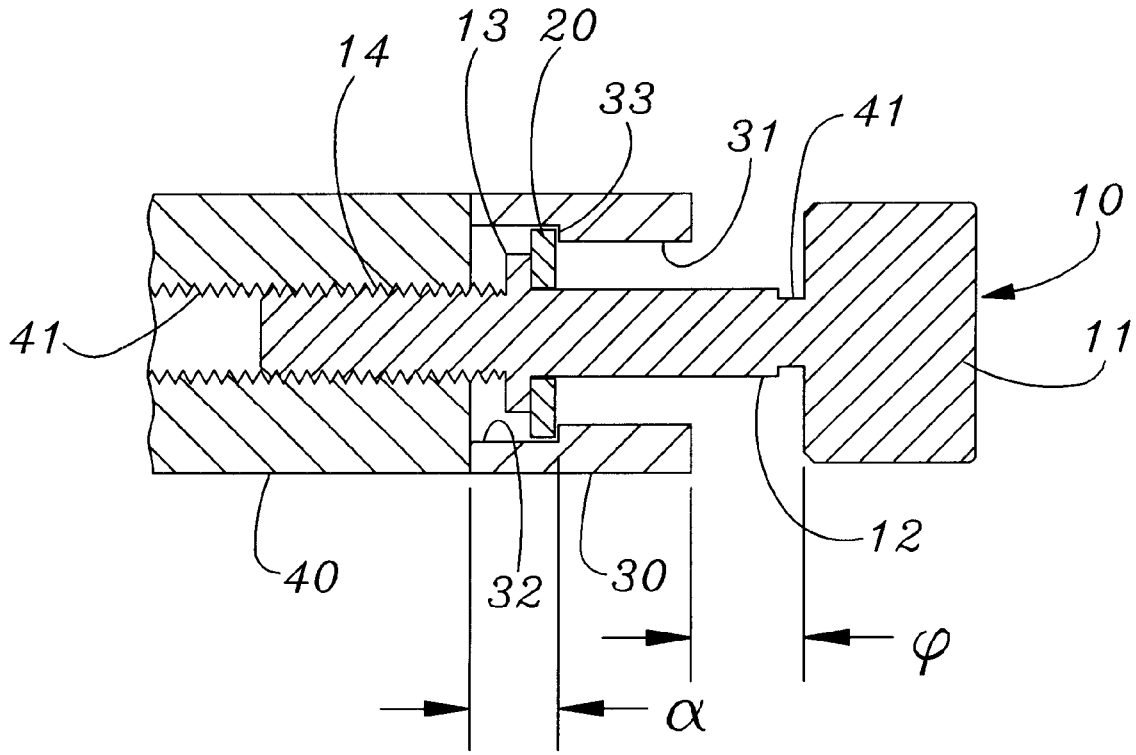
FIG. 3 is a cross-sectional view of the jackscrew system showing mating of the housings of FIGS. 2A and 2B with the jackscrew and retainer ring as viewed along line 3—3 of FIG. 2A.

FIG. 3 best shows the jackscrew system in accordance with the invention, showing in cross-section the mating of the housings of FIGS. 2A and 2B with the jackscrew 10; and retainer ring 20 as viewed along line 3—3 of FIG. 2A; Referring primarily to FIG. 3, the diameter of jackscrew shoulder is designed to be less than that of aperture 31 and the length of jackscrew 10 is such that shoulder 13 can be projected through aperture 31 and into counter-bored recess 32 The diameter of jackscrew head 11 is greater than that of aperture 31 to restrict head 10 from entering aperture 31.

C-shaped retaining ring 20 has an outer diameter smaller than the diameter of counter-bore 32 but larger than the diameter of recess 31 and thus of shoulder 13. In operation, jackscrew 10 is inserted through recess 31 a distance to permit shoulder 13 to exit counter-bored recess 32 sufficiently so that retaining ring 20 can be crimped onto jackscrew shaft portion 12 behind shoulder 13. Thus, as shown in FIG. 3, dimension $\alpha$ must be sufficiently less than dimension $\phi$ to allow shoulder 13 to project far enough from counter-bore 32 so that ring 20 may be properly crimped onto jackscrew shaft 12. Additionally, the configuration of jackscrew 10 is such that shoulder 13 does not meet the threads of receptacle connector 40 when it is fully mated to plug connector 30.

The inner diameter of crimp ring 20 is smaller than the diameter of the shoulder 13 with the outside diameter larger than that of both shoulder 13 and recess 31. Thus, when crimped in place onto non-threaded portion 12 adjacent shoulder 13, ring 20 operates to capture and prevent removal of the jackscrew 10 from the plug body 30. Since the jackscrew head 11 is of a diameter to prevent passage through the recess 31, the combination of the crimped retainer ring 20 and jackscrew head 11 capture the jackscrew 11 within the connector plug 30.

Thus, it is seen that connector body 30 has recess 31 for accepting the shaft of jackscrew 10 therethrough and counter-bore 32 for accepting retaining ring 20, with threaded portion 14, shoulder 13 extending through counter-bore 32 sufficiently to allow retaining ring 20 to be crimped onto non-threaded portion 12 adjacent shoulder 13 between head 11 and shoulder 13. Jackscrew head 11 and counter-bore 32 have diameters greater than that of recess 31 with counter-bore 32 terminating in an interior surface downsizing at surface 33 to recess 31. Thus, as explained, shoulder 13, retaining ring 20 and interior surface 33 cooperate to capture jackscrew 10 within sub-assembly housing 30 during mating and de-mating procedures.

When mating the connector plug 30 to connector receptacle 40, the jackscrews are inserted to protrude through recesses 31 and counter-bores 32 and retainer ring 20 is crimped onto nonthreaded portion 12 as explained. Connector bodies 30 and 40 are then initially engaged and jackscrew 10 is rotated clockwise within body 30 to progressively engage threads 41 of body 40.

With continued rotation the force of the jackscrew head 11 against the body 30 draws body 30 and receptacle 40 together to complete the aligned mating of the bodies. The location of the shoulder 13 on jackscrew 10 is such that with ring 20 crimped to shaft 12, shoulder 13 does not meet the threads 41 of the receptacle 40 when the bodies 30 and 40 are fully mated. The counter-bore 32 further serves to provide an axial tolerance to assure sufficient jackscrew thread engagement with the receptacle body 40. Additionally, crimp ring 20, when crimped around the shaft of jackscrew 10, creates thrust interaction with screw shoulder 3 to provide for self- centering of the screw 10 when engaged with receiving threads 41 of receptacle body 40.

When de-mating the connectors, jackscrew 11 is rotated counter-clockwise to progressively disengage the jackscrew threads 14 from the coupling threads 41 of body 40. Since the outer diameter of ring 20 is greater that the diameter of recess 31, this progressive disengagement causes the jackscrew shoulder 13 to force retaining ring 20 against the surface 33 of counter-bored hole 31, jackscrew 10 therefore being restrained from opening under the applied de-mating forces. Retainer ring 20 thus acts as a thrust bearing between the shoulder 13 and the plug body 30 to disengage bodies 30 and 40.

In operation as described, the interrelated action of the ring 20 and the body surface 33 of counter-bored recess 32 thus captures the jackscrew, provides transaxial mating tolerance within counter-bore 31, and enables controlled mating and de-mating of the sub-assemblies. This interrelation prevents undesirable mating and de-mating problems associated with conventional jackscrews. Thus, in accordance with the present invention there has been shown and described a jackscrew system for mating and de-mating multiple connector electrical sub-assemblies, and more particularly, to a jackscrew system preventing undesired mounting and de-mounting problems of miniature electrical sub-assemblies.

While there has been shown and described a preferred embodiment, it is to be understood that various other adaptations and modifications will be apparent to those skilled in the art. It is intended that such adaptations and modifications be encompassed in the following claims.

Accordingly, what is claimed is:

1. An electrical connector sub-assembly comprising:

a housing having a first entrance cavity and a second interconnecting exit cavity for receiving a jackscrew for mating and de-mating of said sub-assembly to a second sub-assembly;

a jackscrew having a head with a smaller diameter shaft extending longitudinally therefrom, said shaft having a non-threaded portion immediately following said head and terminated by a thrust shoulder extending axially therefrom, said thrust shoulder followed by a threaded portion that terminates said shaft;

said first entrance cavity having a diameter sized for accepting said jackscrew shaft but excluding said head;

said second cavity counter-bored of enlarged diameter to provide a counter-bore termination area downsizing generally perpendicularly to connect to said first entrance cavity;

a retention ring disposed in said second cavity abuttingly positioned between said thrust shoulder and said counter-bore termination area to thereby capture said shoulder within said second cavity for retaining said jackscrew shaft in said sub-assembly during mating and de-mating of said sub-assembly and said second sub-assembly for retaining said jackscrew in said sub-assembly.

2. The electrical connector sub-assembly of claim 1 wherein said housing is a dual cavity housing and said retaining ring has an outside diameter less than the inside diameter of said exit cavity but greater than both the diameter of said shoulder and of said entrance cavity, and an inside diameter less than the diameter of said shoulder.

3. The electrical connector assembly of claim 2 wherein said dual cavity housing, is configured for accepting said jackscrew shaft and said counter-bore is configured for accepting said retention ring, and said jackscrew shaft extends through said counter-bore sufficiently to allow said retention ring to be crimped onto said shaft between said counter-bore termination area and said shoulder.

4. The electrical connector assembly of claim 2 wherein said jackscrew head and said counter-bore have diameters greater than that of said entrance cavity and said counter-bore terminates in an interior surface downsizing to said entrance cavity, and said shoulder, said retaining means and said interior surface cooperate to capture said jackscrew shoulder within said housing.

5. The electrical connector sub-assembly of claim 2 wherein said retention ring comprises an annular ring having a portion removed to form a C-shaped configuration, said ring having a thickness substantially one-third the inner diameter of said ring.

6. The electrical connector sub-assembly of claim 2 wherein said retention ring comprises an annular ring having a portion removed to form a C-shaped configuration for crimping over said non-threaded portion of said jackscrew shaft.

7. The electrical connector sub-assembly of claim 6 wherein in operation said shaft is inserted into said entrance cavity and through said exit cavity until said emergence of said shoulder, with said retention ring crimped onto said non-threaded portion adjacent said shoulder between said counter-bore termination area and said shoulder.

8. The electrical connector sub-assembly of claim 6 wherein said shaft includes a shear-groove immediately adjacent said head, said shear-groove acting to cause said head to shear from said shaft when excess torque is applied to said head thereby providing easy access for removal and replacement of said jackscrew after removal of said retention ring.

9. An electrical connector sub-assembly for mating and de-mating electrical connectors comprising:

a dual cavity housing having an entrance cavity, and a larger diameter counter-bored interconnecting exit cavity for receiving a jackscrew for mating and de-mating of said sub-assembly and another sub-assembly;

a jackscrew including a jackscrew head with a smaller diameter shaft extending longitudinally therefrom, said shaft having a non-threaded portion followed by a shoulder portion extending axially from said non-threaded portion, and a threaded shaft portion following said shoulder portion, said entrance cavity configured for receiving said shaft while excluding said head; and a retaining ring for capturing and retaining said jackscrew within said exit cavity to prevent dislodgment of said jackscrew during mating and de-mating of said connectors.

10. The electrical connector sub-assembly of claim 9 wherein said shaft of said jackscrew means therethrough and said larger diameter counter-bore is configured for accepting said retaining means, and said jackscrew shaft extends through said counter-bore sufficiently to allow said retaining ring to be crimped onto said shaft between the terminating surface of said counter-bore and said shoulder.

11. The electrical connector sub-assembly of claim 10 wherein said jackscrew head and said counter-bore have diameters greater than that of said entrance cavity and said counter-bore terminates in an interior surface downsizing to said entrance cavity, and said shoulder, said retaining means and said interior surface cooperate to capture said jackscrew within said housing.

12. The electrical connector sub-assembly of claim 11 wherein the outside diameter of said retaining ring and the diameter of said counter-bore are configured to provide transaxial tolerance for controlled mating and de-mating of said electrical connectors.

13. The electrical connector sub-assembly of claim 12 wherein said retaining ring comprises an annular ring having a portion removed to form a C-shaped configuration for crimping over said non-threaded portion of said jackscrew adjacent said shoulder portion between said interior surface and said shoulder portion.

14. A jackscrew system for mating and de-mating electrical connectors comprising:

(a) a jackscrew having a head with a shaft extending longitudinally therefrom, said shaft including a non-threaded portion adjacent said head followed by a shoulder portion extending axially from said non-threaded portion, and a threaded shaft portion following said shoulder portion;

(b) a first connector having a housing including an entrance cavity for receiving said jackscrew shaft and an enlarged exit cavity counter-bored within the mating face of said first connector and interconnected to said entrance cavity; and (c) a jackscrew retainer crimped over said non-threaded portion of said jackscrew in said exit cavity between said shoulder and the interface of said entrance cavity and said exit cavity for capturing said jackscrew within said first connector to thereby prevent dislodgment of said jackscrew.

15. The jackscrew system of claim 14 wherein said jackscrew head and said counter-bore have diameters greater than that of said entrance cavity and said counter-bore terminates in an interior surface downsizing substantially perpendicularly to said entrance cavity, and said shoulder, said retaining means and said interior surface are configured to capture said jackscrew means within said exit cavity.

16. The jackscrew system of claim 15 wherein said first connector is a dual cavity housing comprising said entrance cavity and said exit cavity.

17. The jackscrew system of claim 15 wherein said jackscrew retainer comprises an annular ring having a portion removed to form a generally C-shaped configuration.

18. The jackscrew system of claim 17 wherein said annular ring has an outside diameter less than the inside diameter of said exit cavity but greater than both the diameter of said shoulder and of said entrance cavity, and an inside diameter less than the diameter of said shoulder, the thickness of said annular ring being substantially one-third the inner diameter of said ring.

19. The jackscrew system of claim 14 further including a second connector for mating to said first connector, said second connector having threads for mating with said threaded portion of said shaft, and said shoulder is located on said shaft such that wherein said first connector is fully mated to said second connector said shoulder does not come into contact with the threads of said second connector.

20. The jackscrew system of claim 15 wherein said shaft includes a shear-groove in said non-threaded portion immediately following said head.

21. An electrical connector system for mating, and de-mating, electrical sub-assembly connectors comprising:

first and second sub-assembly connectors;

a jackscrew having a head with a shaft extending longitudinally therefrom, said shaft having a non-threaded portion immediately following said head and terminated by a thrust shoulder extending axially therefrom, said thrust shoulder followed by a threaded portion that terminates the shaft;

a dual cavity housing in said first connector having an entrance cavity of a diameter for accepting said jackscrew shaft but excluding said head, and an interconnecting counter-bored enlarged exit cavity having a termination area downsizing generally perpendicularly to said entrance cavity;

a housing in said second connector having female threads for mating with said threaded portion of said shaft wherein said shoulder is located on said shaft such that wherein said first connector is fully mated to said second connector said shoulder does not come into contact with the female threads of said second connector; and a retaining ring abuttingly positioned in said exit cavity between said thrust shoulder and said counter-bore termination area to thereby capture said thrust shoulder within said counter-bored cavity to provide capture and retention of said jackscrew shaft in said exit cavity during mating and de-mating of said first connector and said second connector.

22. The electrical connector system of claim 21 wherein when de-mating said first and second connectors, and said jackscrew head is rotated to disengage said first and second connectors, said shoulder forces said retaining ring against said counter-bore termination area to thereby restrain said jackscrew from opening under de-mating forces.

23. The electrical connector system of claim 21 wherein said retaining ring, is generally C-shaped in the form of an annular ring with a portion thereof removed and has an inside diameter less than the diameter of said shoulder and an outside diameter greater than both the diameter of said shoulder and of said entrance cavity.

24. The electrical connector system of claim 21 wherein when mating said first and second connectors said jackscrew is inserted through said first housing so that said retaining ring is positioned between said shoulder and said counter-bore termination area, said threaded portion is engaged with said female threads and said head is rotated to draw said head against said entrance cavity to complete the mating, and whereby:

(a) said shoulder is located on said shaft such that said shoulder does not come into contact with the female threads of said second connector;

(b) said counter-bore provides axial tolerance to assure sufficient thread engagement between said first and second connectors; and (c) said retaining ring provides thrust interaction with said shoulder to provide for self-centering of said jackscrew for engagement with said female threads.

25. The electrical connector system of claim 24 wherein said shaft includes a shear-groove immediately adjacent said head to cause said head to shear from said shaft under excess torque thereby providing easy access to and replacement of said shaft from said first connector after removal of said retainer ring.

* * * * *